US005549529A

United States Patent [19]

Rasmussen

[11] Patent Number: 5,549,529

[45] Date of Patent: Aug. 27, 1996

[54] TRACTION SLED EXERCISE MACHINE

[76] Inventor: Aaron P. Rasmussen, 1776 Essex St., El Cajon, Calif. 92020

[21] Appl. No.: 533,340

[22] Filed: Sep. 25, 1995

[51] Int. Cl.[6] ..... A63B 21/068

[52] U.S. Cl. ..... 482/96; 482/97

[58] Field of Search ..... 482/96, 95, 72, 482/133

[56] References Cited

U.S. PATENT DOCUMENTS 5,334,120 8/1994 Rasmussen ..... 482/106

*Primary Examiner*—Richard J. Apley
*Assistant Examiner*—John Mulcahy

[57] ABSTRACT

A traction sled exercise machine that provides two distinct exercise cycles, each of which employs bodily force to overcome gravity and elevate a body sled and user on an inclined frame supported rail from a point of origin to a point of destination. The structure and mechanics of this apparatus permits the user to confront machine resistance in a front or rear facing anatomical position. In either instance, arm force is extended through a block and tackle leveraging system, supplemented with leg pressure on one of two sets of adjustable foot stirrups provided for leg participation in the elevation task.

The body sled has a companion mechanism, called the force beam assembly, designed to help regulate machine resistance. In that assembly, the body sled is in pivotal connection with a force bar that carries a position adjustable, weighted hanger. The bar and hanger, in turn, are suspended in moveable fashion on a fulcrum mounted frame, wherein elevation of the sled produces oscillation of the frame and reciprocation of the bar and weighted hanger. That movement of force relative to the fulcrum reduces machine resistance during anatomically difficult phases of an exercise cycle. Also, overall increases or decreases in resistance may be obtained by repositioning the weighted hanger on the force bar.

12 Claims, 6 Drawing Sheets

TRACTION SLED EXERCISE MACHINE

BACKGROUND OF THE INVENTION

The present invention is a descendent of exercise machines that utilize body gravity as a resistance force. Typically, they comprise a frame to support an inclined rail or rails which operate to track a body sled or carriage from a point of origin to a point of elevation. The sled, in turn, supports the torso, releasing the arms and/or legs to apply bodily force through conventional leverage systems to effect elevation of the body sled against the force of gravity. Examples of the above described machines are found in the patents of Coyle, U.S. Pat. No. 4,176,836, issued on Dec. 4, 1979, Van Straaten, U.S. Pat. No. 4,911,438, issued on Mar. 27, 1990, and Rasmussen, U.S. Pat. No. 5,334,120, issued on Aug. 2, 1994. These patents, and others, demonstrate continuous evolution in the utility of these machines, broadening their application with an increased emphasis on human engineering. Not withstanding such progress, experiments with a number of exercise clients, using several state of the art machines of this class, reveal a need for continuing biomechanical improvements including: (1) A need to selectively reduce gravitational resistance of a machine during that phase of the cycle when there is a transition in body mechanics that places the body in an awkward position, for example, such a transition occurs at the approximate midpoint of one exercise cycle when a pulling down motion, involving the biceps, is switched to a pushing down motion involving the triceps. (2) The need to develop a resistance control system, separate from body gravity, as an auxiliary method for incrementally increasing or decreasing the bodily effort required to elevate the sled, thereby accommodating individual strength parameters. (3) The need to increase the versatility of this class of machines with structure that allows alternate body cycles or positions to increase the participation of muscle groups not originally served with a single cycle. (4) The need to continue the development of low impact, traction oriented machines that reduce shock and compression on the spinal column and joints. The present invention addresses the cited needs.

SUMMARY OF THE INVENTION

The traction sled invention contemplates an apparatus that permits a front facing or rear facing exercise client to employ upper and lower body forces to elevate the body on a on a sled, reciprocally supported on an inclined rail, to a point of maximum elevation. According to this device, bodily force is applied with levers and block and tackle components to overcome gravitational resistance during the ascent phase of the cycle and to slow descent during the return. Unique to this invention, is an auxiliary entity called the force beam assembly, primarily employed to increase or decrease machine resistance and secondarily, used to introduce variable resistance to the elevation cycle. Drawing FIGS. 9A, 9B, and 9C provide an overview of a front facing exercise client during one exercise cycle and FIGS. 10A and 10B illustrate a rear facing client during a second exercise cycle. A detailed description of the operation of the force beam assembly is provided in the Preferred Embodiment section of this disclosure. The objectives of this invention are corollary to the needs as identified in the Background Of The Invention section.

One of the objectives of the traction sled was to incorporate a variable resistance force beam assembly that could operate to reduce machine resistance during that phase of the exercise cycle when there is a transition of body mechanics that results in an identified weakness, i.e. change from a pulling to a pushing motion.

Another objective was to modify machine resistance by providing a weighted hanger that can be adjusted on a force bar to increase the resistance of the body sled to elevation, or conversely, it can be adjusted to provide a negative force to reduce the resistance of the sled to elevation.

Another objective was to expand the application of the invention with two exercise cycles that would enable and exercise client to operate the apparatus in a front or rear facing position to obtain a breadth of exercises not obtainable on conventional machines of like class.

Another objective of the invention was provide the user with full body, low impact, traction type exercises that minimize shock and spinal compression.

PREFERRED EMBODIMENT OF THE INVENTION

Figure 1:
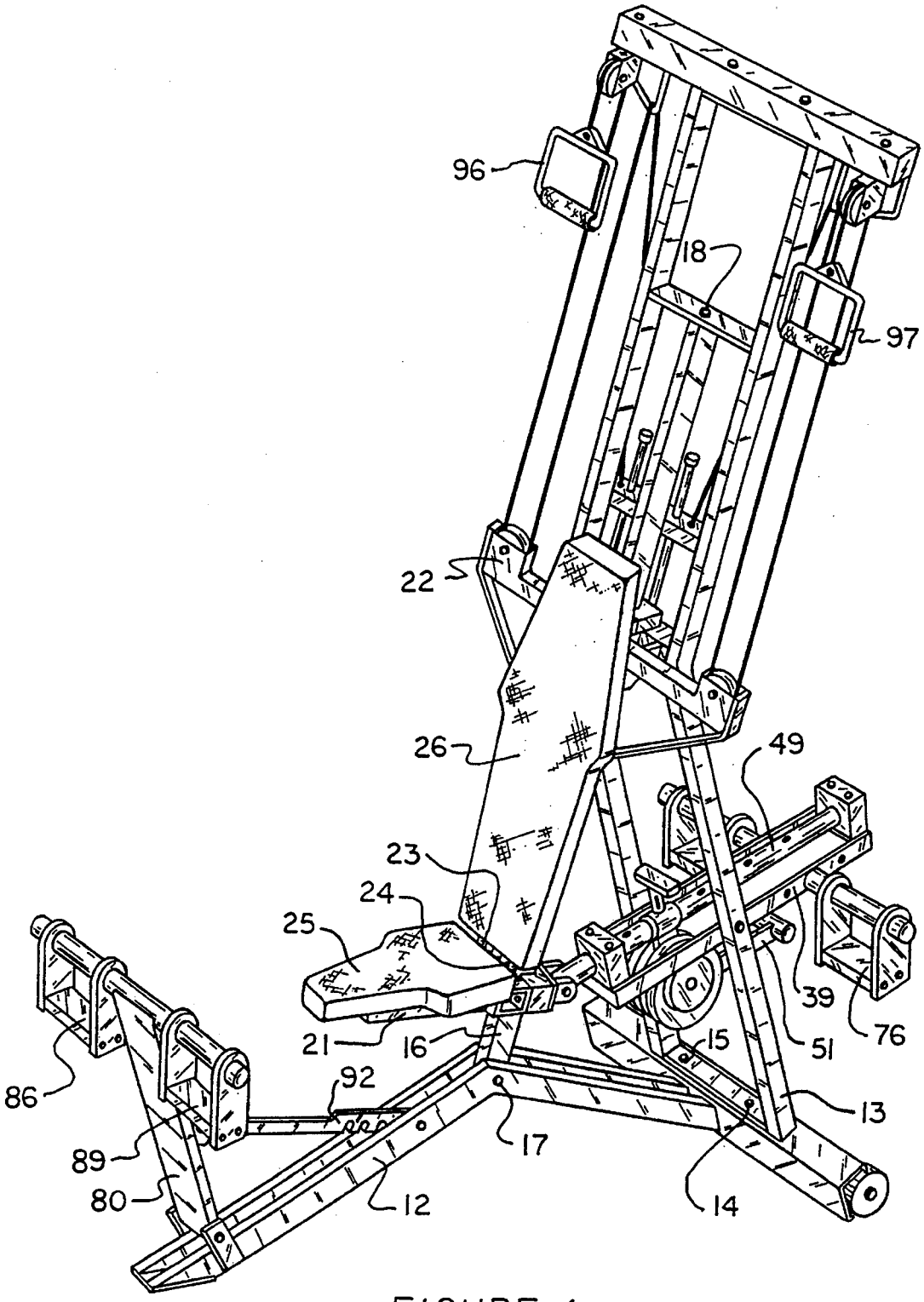
FIG. 1 is a perspective assembly drawing of the traction sled indicating form and component relationships.

The assembled Traction Sled Exercise Machine shown in FIG. 1 has a fixed frame assembly composed of three frame members. Base member 12 is joined to standard 13 with assembly bolts 14 and 15. Rail 16 is attached, at its bottom end, to base 12 with bolt 17 and is joined to standard 13 with bolt 18 at its top end. In addition, rail 16 is braced to standard 13 with bolts 19 and 20 as best shown in FIG. 5A. All other frame appendages are weldment joined.

Figure 3:
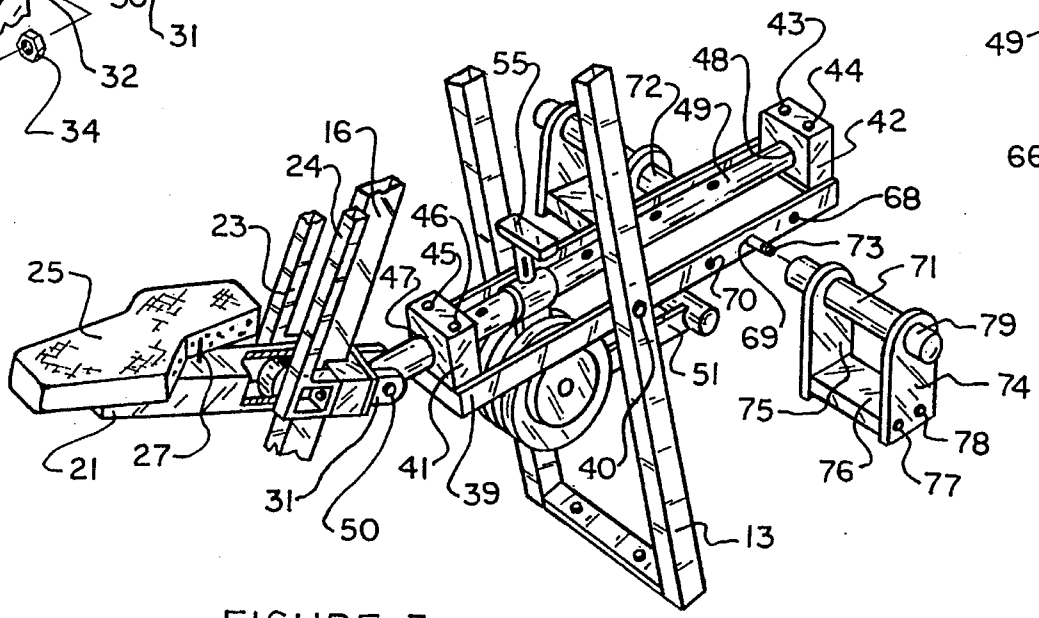
FIG. 3 is a perspective drawing of the force beam assembly coupled to the sled frame and seat at the front, with foot stirrup connections at the rear.
Figure 2:
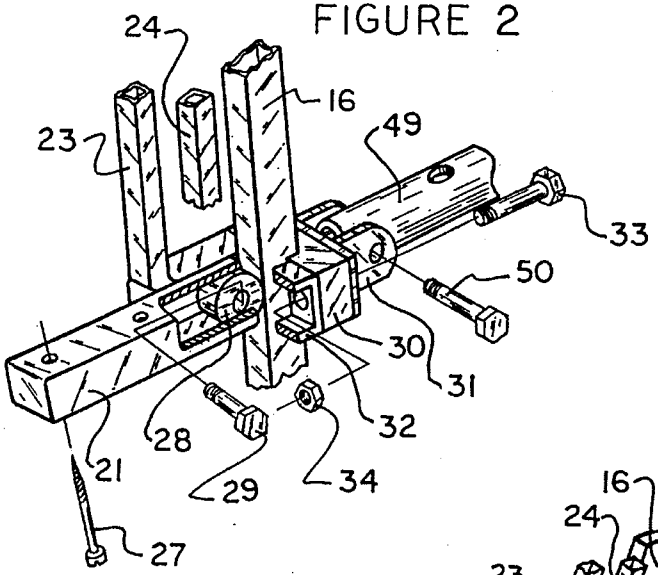
FIG. 2 is a perspective drawing depicting the sled to rail connective structure, with broken out sections to reveal the roller and glide block assembly.
Figures 6, 7, 8:
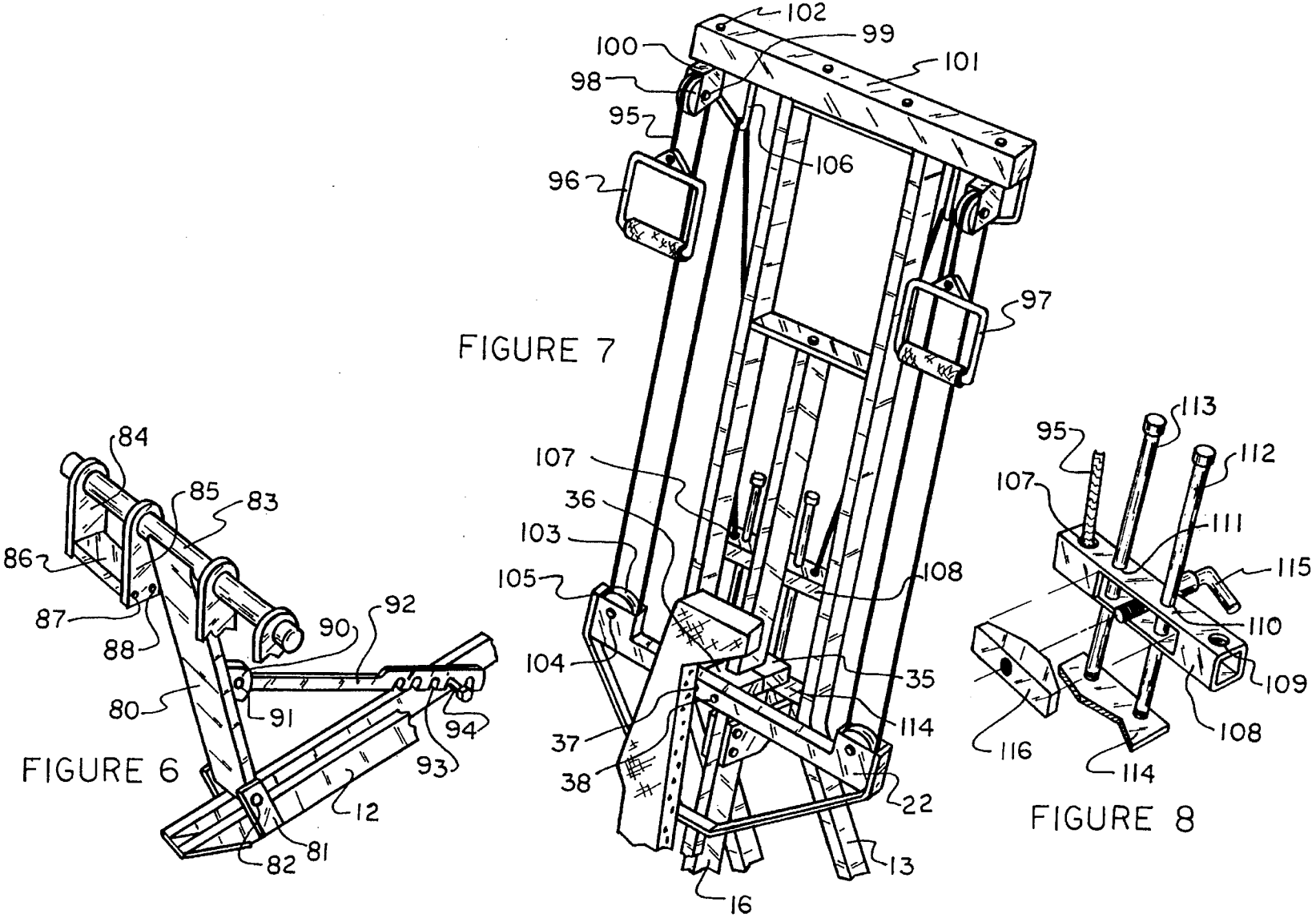
FIG. 6 is a perspective drawing depicting the leg lever assembly with attached foot stirrups and notched brace, the latter entity for positional adjustment.
FIG. 7 is a perspective drawing of the hand ring lift system illustrating line flow and terminal connections.
FIG. 8 is an exploded perspective drawing of the line adjusting clamp.

Also shown in FIG. 1 is sled frame 21, an assembly of welded parts including suspension crossbar 22 and back support members 23 and 24. Seat 25 and backrest 26 are attached to frame 21 with screws, as typified by screw 27 as shown in FIG. 3. FIG. 2 illustrates the lower portion of the sled tracking system with attendant hardware. In that view, roller 28 is shown to be rotatably supported within frame 21 by axle bolt 29. It functions to reduce interface friction with rail 16. Track containment and alignment is achieved with Delrin plastic glide block 30, notched to fit the rail and backed with coupler yoke 31. The yoke and glide block 30 are fixed to frame appendage 32 with bolt 33 and nut 34 along with identical, left side, counterpart hardware that is not visible. The sled frame has a second tracking connection with rail 16 that is best illustrated in FIG. 7. Shown therein is a pair of notched Delrin glide blocks identified as 35 and 36. These blocks encase the rail and are fastened to sled crossbar 22 with bolts 37 and 38. The described tracking components provide rotary motion at the point of greatest pressure, augmented with sliding fit glide blocks, to insure lineal stability for the sled during its reciprocal run.

FIG. 3 offers the most explicit view of the force beam assembly. It consists of a rectangular frame 39 that is pivotally suspended near the midpoint of each lateral side of the frame as indicated with typical fulcrum bolt 40 and a left side counterpart. Residing at each end of frame 39 are pillow blocks 41 and 42 which are locked in place with four bolts labeled 43, 44, 45, and 46. Those blocks have bores 47 and 48 to carry force bar 49 in slip fit reciprocal motion. At its front end bar 49 is joined in pivotal union with sled yoke 31 by bolt 50, so that reciprocal motion of the sled oscillates the force bar on its fulcrum point, which in turn causes the bar to reciprocate in unison with sled motion.

Figure 4:
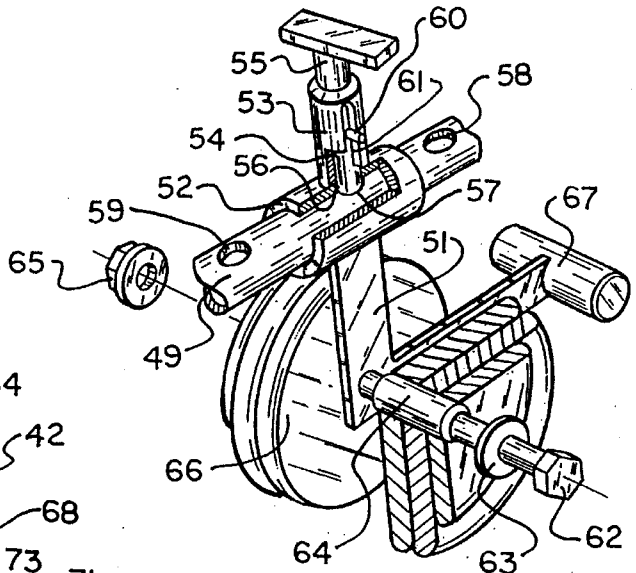
FIG. 4 is an enlarged perspective drawing with broken out sections that indicate the configuration of the weighted hanger and its positioning mechanism.

FIG. 3 also indicates that the force bar 49 supports a weighted hanger 51, and FIG. 4 provides an enlarged view of that hanger and the mechanism by which it may be relocated on the bar. In that view, hanger 51 is shown with broken sections to reveal sleeve 52, sized to slip fit over force bar 49. Weldment joined at the top of that sleeve is bushing 53 with bore 54 containing drop pin 55, a gravity loaded shaft that is shown to penetrate hole 56 of sleeve 52 to lock in hole 57 of force bar 49. Holes 58 and 59 represent a number of force bar holes that may be used for alternate hanger positioning. Roll pin 60, shown penetrating drop pin 55, permits limited vertical travel of the shaft within slot 61 milled in bushing 53. Lifting drop pin 55 disengages contact with the force bar and permits the client operator to change the location of the hanger. Suspended at the bottom of the hanger 51 with bolt 62, washer 63, insert 64, and nut 65, are weight plates 66. At the very rear of the hanger is placed a handle 67 to facilitate adjustment of the assembly.

Locating the hanger 51 forward of the force beam fulcrum 40, as shown in FIG. 3, places force between the fulcrum and the sled, resulting in a third order leverage system, while locating the hanger to the rear of the fulcrum results in a first order leverage. The former location increases the resistance to sled elevation and the latter reduces that resistance. Correspondingly, the previously described reciprocation of the force bar 49 and hanger 51 (during elevation and descent of the sled frame 21) functions to decrease resistance at the midpoint of the reciprocal cycle.

The force beam frame, shown in FIG. 3, has a secondary function. It supports two pivotal stirrups that afford lower body action for the rear facing exercise client. It may be observed that frame 39 exhibits three adjustment holes, 68, 69, and 70, on the right side and to the rear of fulcrum bolt 40, with three like holes on the left side that are not visible. These holes provide for positional adjustment of support rounds 71 and 72 respectively. Stud 73 may be seen emerging from hole 69 to thread into round 71, which in turn, rotatably supports sheath 74 and 75. Located at the base of the sheaths is a footpiece 76, fixed in place with through bolts 77 and 78. Finally, end cap 79 is press fit on round 71 to retain the stirrup. A like assembly is suspended from round 72 on the left side of the frame, which mirrors the right. Adjustment of the stirrups from hole to hole alters the distance between the sled seat and the footpiece.

Figure 5C:
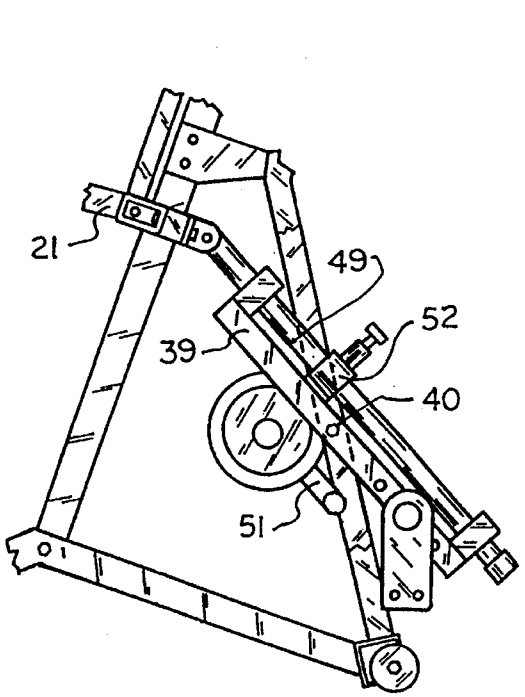
FIGS. 5A, 5B, and 5C are sequential drawings that represent the interaction of the sled frame and the forced beam assembly during elevation of the sled from the point of origin, shown in FIG. 5A to a transition point, as shown in FIG. 5B, to peak elevation, as shown in FIG. 5C.
Figure 5B:
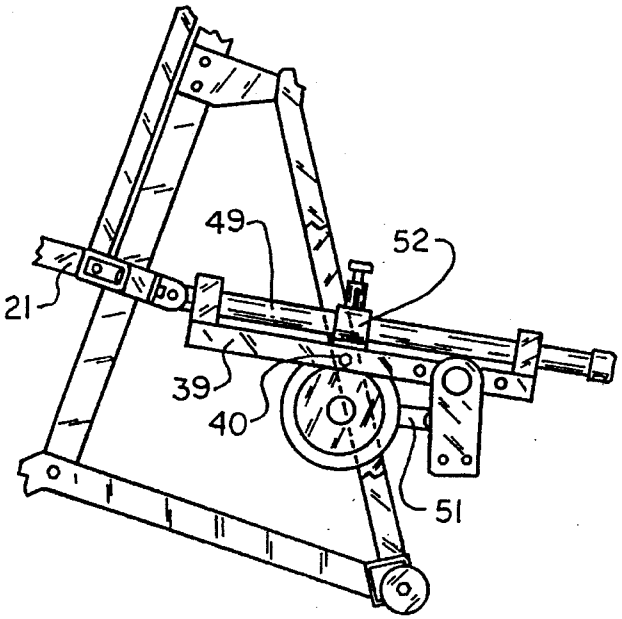
Figure 5A:
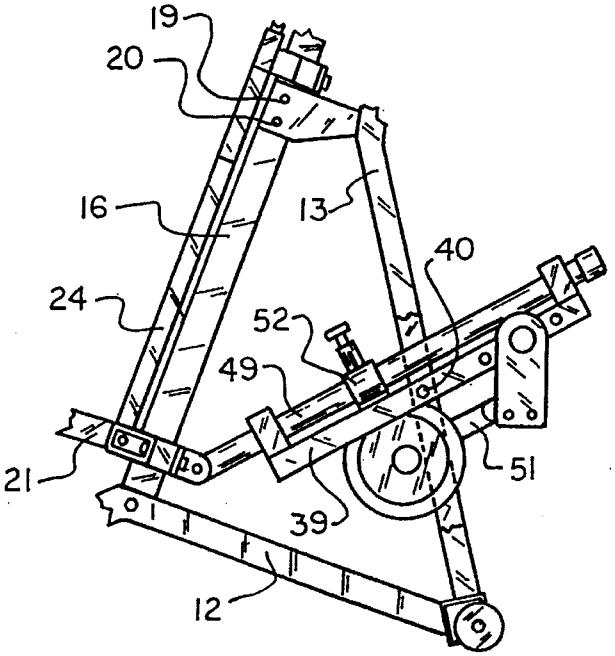

The operation of the force beam assembly may be better understood through sequential drawing FIGS. 5A, 5B, and 5C which relate the interaction of that mechanism and the sled at three stages of the elevation cycle. FIG. 5A depicts the force beam assembly at rest; In that illustration, the hanger sleeve 52 has been adjusted to a position forward of the fulcrum 40, adding resistance to elevation of the sled frame 21. It may be observed that upward ascent of the sled moves the force bar 49 and the hanger sleeve 52 toward the rear end of the force frame 39 to a position above the fulcrum as indicated in FIG. 5B. Continued ascent causes the weighted sleeve to reverse direction and to move, once again, to the front of the fulcrum 40, as shown in FIG. 5C. Had the hanger sleeve 52 been initially adjusted to the rear of the fulcrum in FIG. 5A, the resistance to sled frame elevation would be reduced, but the variable resistance principle would remain constant and the point of least resistance to ascent would again occur in the position shown in FIG. 5B. The practical application of the described resistance cycle is apparent in later figures and discussions relating to human factors.

FIGS. 6, 7, and 8 all relate to apparatus employed to elevate the Traction Sled from a point of origin to a point of elevation. FIG. 6 pertains to the leg lever assembly which includes the leg lever 80, pivotally joined to the front end of base frame 12 via bracket 81 and pin 82. At its top end, lever 80 supports crossbar 83 which functions to carry a pair of leg lever stirrups similar to those found on the force beam assembly. The principle components of the stirrup include typical support sheaths 84 and 85 with footpiece 86, attached with through bolts 87 and 88. The right side footpiece, number 89, which is not shown in FIG. 6, appears in FIG. 1. In FIG. 6, bracket 90 and clevis pin 91 function as a hinge point for brace 92 which extends to a series of slots 93 that offer positional adjustment for the leg lever. Bolt body 94 penetrates base frame 12 to provide fixed point engagement with one of the slots. Gravity maintains that engagement until the lever is manually adjusted to another slot.

FIG. 7 illustrates the upper body lift apparatus which includes components basic to block and tackle leverage systems. In that figure, the left side components and line pathways are more clearly delineated than are those on the right. Since the right side mirrors the left, and would only produce redundant information, only the left components are identified by number for discussion. Line 95 is knotted to handring 96, whose right side counterpart is numbered as handring 97. From handring 96, the line travels upward over a fixed pulley 98 which rotates on axle 99 in housing 100. That housing is pivotally suspended from the standard tee bar 101 with shoulder bolt 102. From pulley 98, line 95 moves downward to circumscribe moveable pulley 103, which is supported by axle 104 in cavity 105 of the crossbar 22. It may be noted that axle 104 is rotated ninety degrees from the normal operating plane of stationary axle 99. That rotation simplifies the fabrication of crossbar 22 and subsequent support structure. From pulley 103, line 95 moves upward a second time to pass over anchor bar 106, a connective appendage of the crossbar 101. From the anchor bar, line 95 progresses downward on a diagonal path to join with an adjustable bar clamp, best illustrated in FIG. 8. Line 95 is shown entering hole 107 of clamp housing 108, where it is knotted in the interior of that housing. Hole 109 is the counterpart of hole 107. Housing 108 has bores 110 and 111 fitted to slide over rods 112 and 113, which are thread mounted in the support appendage 114 of the standard frame 13. Completing the assembly, is a handle 115 which penetrates the housing 108 to thread into a dual tapered bar 116. The handle 115 may be tightened to lock on rods 112 and 113 to secure the position of the handrings in any of a continuum of locations spanning the length of the bars. It may be readily observed that when the handrings are forced downward with a measured arm force, the tackle arrangement nearly doubles that force. That amplification of arm force coupled with conjunctive leg force enables even a poorly conditioned exercise client to elevate the sled on its rail pathway. As was previously discussed, the force beam assembly further modifies the amount of force applied to elevate the sled. It provides the means for increasing, decreasing and varying the resistance of an exercise cycle.

Figure 9C:
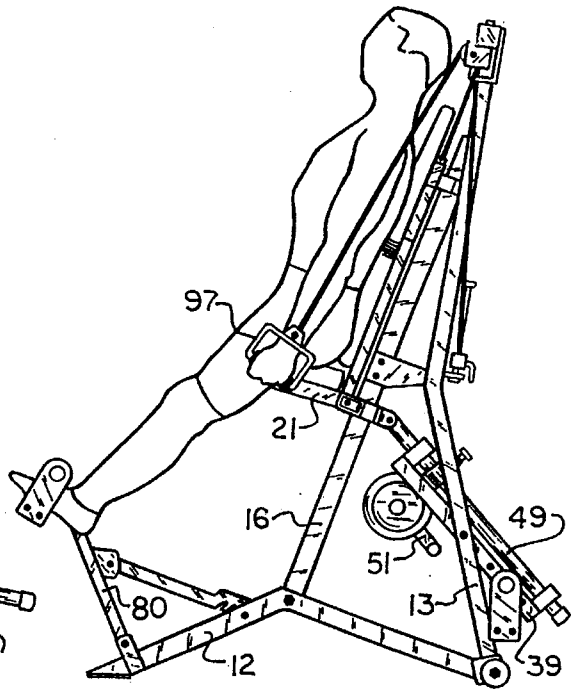
FIGS. 9A, 9B, and 9C are sequential drawings illustrating right side profile views of a male, front facing exercise client at three points of sled elevation, from a point of origin in FIG. 9A to a point of transition in FIG. 9B to a point of peak elevation as shown in FIG. 9C.
Figure 9B:
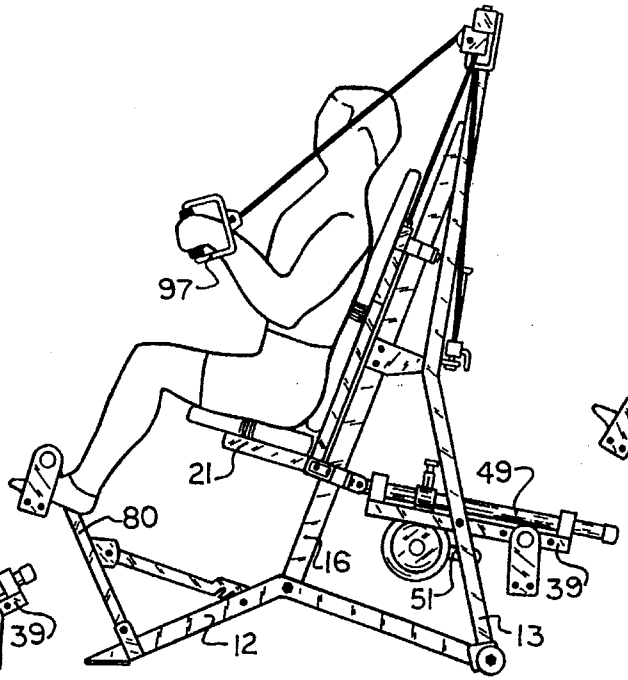
Figure 9A:
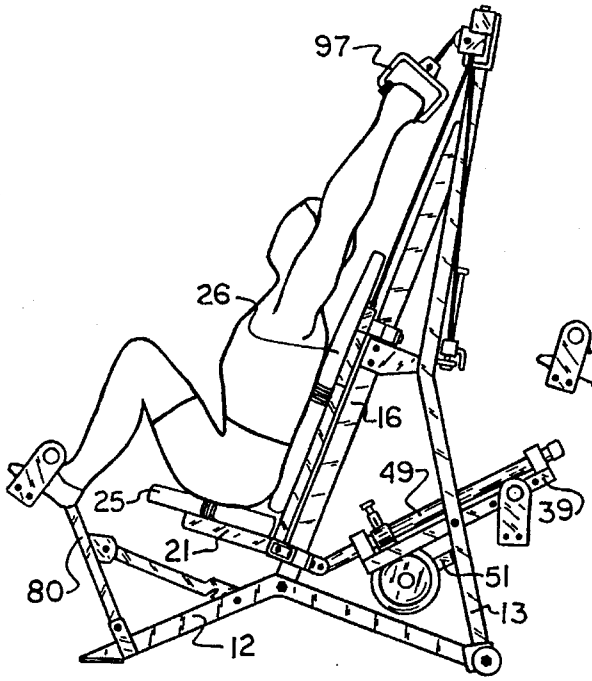
Figure 11:
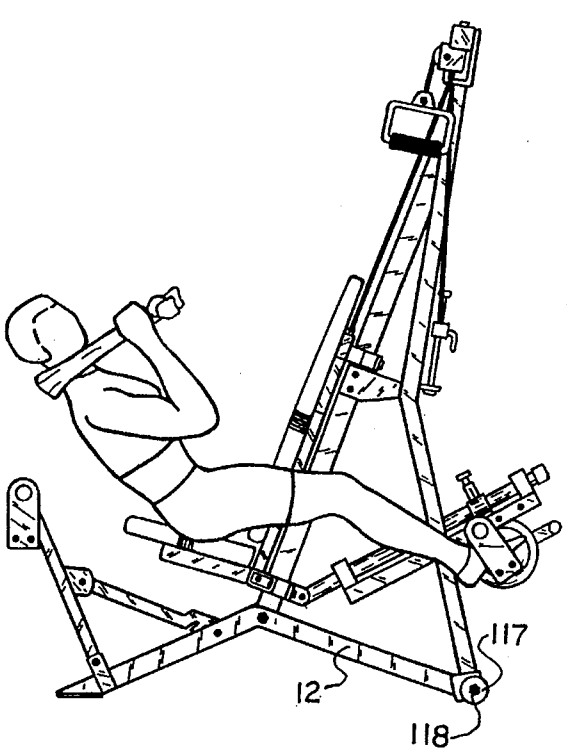
FIG. 11 is a right side profile drawing of a female, rear facing exercise client employing sled support to perform an abdominal crunch exercise.
Figure 10B:
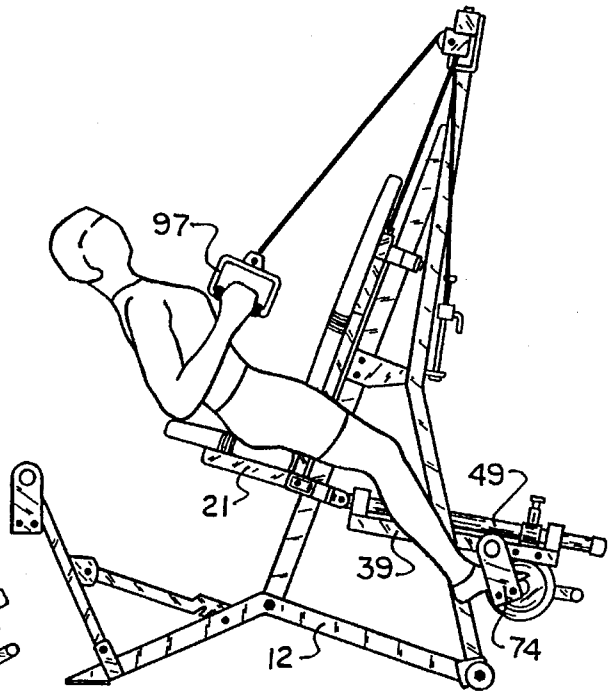
FIGS. 10A, and 10B are sequential drawings showing right side profile views of a female, rear facing exercise client at two points of sled elevation, from a point of origin in FIG. 10A to a full laid out position in FIG. 10B.
Figure 10A:
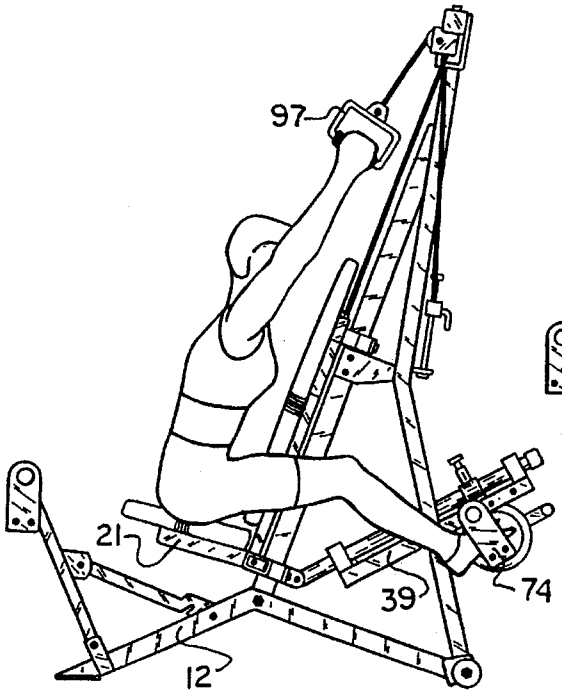

The next series of figures are presented to identify the human factors associated with two exercise cycles. FIGS. 9A, 9B, and 9C relate to a sequence of movements wherein a male front facing exercise client uses both arms and legs to elevate a body sled from a point of origin to full extension. FIGS. 10A and 10B serve the same purpose for a female rear facing exercise client. FIG. 11 illustrates no machine movement. It merely indicates that the machine may also serve as a utilitarian support structure for other exercises.

In FIG. 9A, the male exercise client is shown reclining on the sled seat 25 and backrest 26, poised to use the limbs to exert bodily force to overcome gravity and elevate the sled 21. In that event, a pushing force by the legs against the stationary leg lever 80 will assist sled assent from FIG. 9A through FIG. 9C, or until full extension of the legs occurs. Arm force, on the other hand, will undergo a transition at the midpoint of this exercise cycle. FIG. 9B illustrates that point of transition in body mechanics wherein the initial arm motion of pulling down on the handring 97 changes to a pushing down motion. Evaluation of that phase of this exercise cycle indicates that it is the most ergonomically difficult to execute. Kinesiology, the science of movement, indicates why that is so, but experiments proved the rule. In trial runs with comparable apparatus, motion often stalled at this point. A review of the discussions regarding the function of the force beam assembly as illustrated in FIGS. 3, 4, and 5A through 5C indicate that the force bar 49 and weighted hanger 51 operate to reduce resistance at the midpoint of that exercise cycle as exemplified in FIGS. 5B and 9B. It may be noted, in FIGS. 9A, 9B, and 9C that although the force bar 49 modulates resistance during the exercise cycle, the initial setting of the hanger 51 makes the force beam assembly act as a third order lever to exert a downward force on the sled frame 21.

In FIG. 10A, a female client is shown in the rear facing exercise position. In that figure, arm force on handring 97 will again be augmented by leg pressure on stirrup sheath 74. In this instance, the initial setting for the weighted hanger 51 has been adjusted to the rear of the fulcrum. That setting transforms the force beam assembly to a first order lever and assists leg pressure to exert an upward force on the sled frame 21. In FIG. 10B, the body is extended to a position of limited leverage, and again, the force bar 49 is shown to have advanced to the rear of the frame 39, that movement designed to reduce machine resistance at the awkward phase of that exercise cycle. In summary, the force beam assembly functions to support the foot stirrups and to vary the intensity of resistance. It can also be adjusted to either increase or decrease machine resistance to elevation.

Referring in closing to FIG. 11, it should be noted that wheel 117, shown in that figure and others, attached to the base frame 12 with a bolt 118, and having mirror image counterparts, are optional pieces of equipment for portable handling of the machine. For permanent, stable installation at fixed cite exercise stations, those parts would be removed.

What is claimed is:

1. A traction sled exercise machine comprising:

a fixed frame assembly with component members to include: a base with a front end and a rear end; a standard with a top end and a bottom end; and an inclined rail with a top end and a bottom end;

a body support sled including a frame with a top end and a bottom end; means for tracking said frame in reciprocating motion on said inclined rail; said body sled also having a seat configured to carry a front facing or a rear facing exercise client;

a force beam assembly having a frame with a front end and a rear end; said beam frame provided with a centrally located fulcrum to permit partial rotation of said beam frame relative said fixed frame assembly; each side of said beam frame carrying a foot stirrup between said fulcrum and the rear end of said beam frame;

a force bar with a front end and a rear end; said bar engaged in a sliding fit on said beam frame; said force bar carrying a weighted hanger with means for adjusting the position of said hanger in a continuum of locations to the front or to the back of said fulcrum; the front end of said force bar also having a pivotal coupling with said sled frame, wherein lineal sled movement oscillates the force bar and imparts reciprocal motion to the force bar and weighted hanger;

a leg lever assembly to include a leg lever with a top end supporting two laterally spaced foot stirrups and a bottom end that is supported at the front end of said frame base;

lifting means coupled to both the fixed frame assembly and the body sled for engagement by an exercise client whereby the exercise client may sit in a front facing position to exert a force on said lifting means and on said leg lever stirrups, or to sit in the alternative rear facing position to exert a force on said lifting means and on said force beam foot stirrups as a means to elevate said body sled on said inclined rail.

2. The traction sled exercise machine described in claim 1 wherein the means adjusting said weighted hanger on said reciprocating force bar consists of a sleeve fitted to slide over said force bar and equipped with a drop pin with sufficient vertical travel to release the sleeve for movement of the hanger, or to lock it in place within a series of holes bored in said force bar.

3. The gravity sled exercise machine described in claim 1 wherein the reciprocal rail tracking means includes a sled attached roller and three glide blocks profiled to fit the rail and to support the sled in lineal travel.

4. The gravity sled exercise machine described in claim 1 in which the lifting means includes two lines each having one end attached to a handring, the lines extending upward from the handrings to pass over two fixed pulleys that are pivotally attached to either side of the top end of said standard; said lines exiting said fixed pulleys to circumscribe two moveable lift pulleys that are axially housed on either side of the top end of said sled; the lines proceeding in an upward direction to loop over two fixed anchor bars attached near the top end of said standard, the lines converging to attach to an adjustment means for adjusting the initial position of the handrings.

5. An exercise machine comprising:

a frame;

an inclined rail attached to the frame;

a body support sled slidably engaging the inclined rail and including a seat for supporting a user;

an elongate force bar pivotally mounted to the frame for rotation about a transverse axis and slidably mounted to the transverse axis for reciprocation along its long axis, a first end of the force bar being pivotally coupled to the sled such that movement of the sled along the rail imparts pivotal and reciprocal motion to the force bar;

a weight support for coupling a weight to the force bar on one side of the transverse axis; and lifting means coupled to the frame and sled for manipulation by a seated user to lift the sled along the inclined rail against the force of their own body weight.

6. The exercise machine of claim 5, wherein the weight support is adjustably positionable on either side of the transverse axis.

7. The exercise machine of claim 5, wherein the weight support is adjustably positionable in a continuum of locations along the length of the force bar on either side of the transverse axis.

8. The exercise machine of claim 5, further comprising a foot support attached to the frame for supporting a seated user's feet.

9. The exercise machine of claim 8, wherein the foot support is pivotally connected to the frame and further comprising means for locking the foot support in one of a plurality of positions about the pivot.

10. The exercise machine of claim 5, further comprising a foot engagement means for coupling a user's foot to the force bar whereby a seated user may apply additional force to the force bar to aid in lifting the sled.

11. The exercise machine of claim 10, wherein the foot engagement means comprises foot stirrups coupled to the force bar on the opposite side of the transverse axis from the first end.

12. The exercise machine of claim 5, wherein the lifting means comprises a first pulley coupled to the frame; a second pulley coupled to the body support sled; and a line, one end of the line being attached to the frame, the length of the line passing, in turn, through the second and first pulleys, the line ending in a handgrip for engagement by the user.

* * * * *